US009543677B1

(12) United States Patent
Ferrier

(10) Patent No.: US 9,543,677 B1
(45) Date of Patent: Jan. 10, 2017

(54) QUICK CONNECTOR

(71) Applicant: STEIN INDUSTRIES INC., London (CA)

(72) Inventor: Tim Ferrier, London (CA)

(73) Assignee: STEIN INDUSTRIES INC., London, Ontario (CA)

( * ) Notice: Subject to any disclaimer, the term of this patent is extended or adjusted under 35 U.S.C. 154(b) by 0 days.

(21) Appl. No.: 14/812,603

(22) Filed: Jul. 29, 2015

(51) Int. Cl.
*H01R 4/60* (2006.01)
*H01R 13/00* (2006.01)

(52) U.S. Cl.
CPC ..... *H01R 13/005* (2013.01)

(58) Field of Classification Search
CPC ..... H01R 13/005; H01R 13/523; A47L 9/246; E21B 17/028; F16L 25/01; F16L 53/007; F16L 53/008
USPC ..... 439/191, 192, 195, 332, 335; 174/15.6, 174/15.7, 19
See application file for complete search history.

(56) References Cited

U.S. PATENT DOCUMENTS 1,674,829 A 6/1928 La Bean
2,767,384 A * 10/1956 Burke ..... H01R 13/213 439/864
3,014,194 A * 12/1961 Axel Berglund Wilhelm ..... H01R 13/6392 174/135
3,099,509 A * 7/1963 Duenke ..... H01R 4/50 403/343
3,590,377 A * 6/1971 Sorger ..... G01R 27/28 324/750.25
3,629,547 A * 12/1971 Kester ..... B23K 9/295 174/15.7
3,652,797 A 3/1972 Goodman
3,784,722 A 1/1974 Goodman
3,808,350 A 4/1974 Kluge et al.
3,851,092 A 11/1974 Talley
3,952,141 A 4/1976 Hubner
4,487,990 A 12/1984 Lane et al.
4,614,395 A * 9/1986 Peers-Trevarton .. A61N 1/3752 29/881
4,939,339 A 7/1990 Folkening et al.
4,940,424 A * 7/1990 Odbert ..... H01R 13/6392 439/314

(Continued)

FOREIGN PATENT DOCUMENTS

WO WO 2009027383 A1 3/2009

OTHER PUBLICATIONS

Melting Solutions Limited, "Water Cooled Power Cables", retrieved Aug. 13, 2014 at: http://www.meltingsolutions.co.uk/water-cooled-pwer-cables/, (1 page).

(Continued)

*Primary Examiner* — Abdullah Riyami
*Assistant Examiner* — Vladimir Imas

(57) ABSTRACT

A quick connector has a tubular male member with an interior lumen, an outbound end configured to allow connection to a hose and to a current conductor, and a pair of opposed radially outwardly projecting protuberances. A tubular female member has an interior lumen, an outbound end configured to allow connection to a hose and to a current conductor, and an inbound end sized to receive an inbound end of the male tubular member. The female member has a sleeve with an undercut lip at an inbound end with opposed slots sized to receive the opposed protuberances of the tubular male member.

20 Claims, 6 Drawing Sheets

(56) References Cited

U.S. PATENT DOCUMENTS 5,051,539 A 9/1991 Leathers-Wiessner
5,080,593 A * 1/1992 Neumann ..... B23K 9/323 439/18
5,120,705 A 6/1992 Davidson et al.
5,306,176 A * 4/1994 Coffey ..... H01R 13/6392 439/367
5,378,870 A 1/1995 Krupnicki
5,813,879 A * 9/1998 Russo ..... H01R 13/512 439/367
6,716,048 B2 * 4/2004 Collin ..... H01R 13/6276 439/317
6,739,578 B2 * 5/2004 Barton ..... F16K 1/303 137/606
6,755,675 B2 * 6/2004 Szabo ..... F16L 37/144 439/191
6,776,639 B1 * 8/2004 Dennis ..... H01R 13/5202 439/314
6,796,827 B1 * 9/2004 Chen ..... F21S 8/065 362/406
6,805,383 B2 * 10/2004 Ostrander ..... F16L 37/144 285/149.1
6,878,007 B1 * 4/2005 Decker ..... H01R 13/6392 248/328
6,991,483 B1 * 1/2006 Milan ..... H01R 31/06 439/171
7,001,202 B2 * 2/2006 Robbins ..... H01R 13/625 439/367
7,081,586 B2 7/2006 Rehrig
7,211,766 B2 5/2007 Rehrig
7,214,094 B2 * 5/2007 Kaminski ..... B60D 1/64 439/316
7,357,660 B2 * 4/2008 Togawa ..... F16L 33/227 439/352
7,377,825 B2 * 5/2008 Bankstahl ..... B23K 9/32 439/337
7,497,729 B1 * 3/2009 Wei ..... H01R 9/0524 439/578
7,648,392 B2 * 1/2010 Chambers ..... A61G 7/05769 141/313
7,794,255 B2 * 9/2010 Melni ..... H01R 4/56 439/271
7,934,953 B1 * 5/2011 Solis ..... H01R 13/622 439/578
8,066,525 B2 * 11/2011 Melni ..... H01R 4/56 439/271
8,303,328 B2 * 11/2012 Meynier ..... H01R 13/622 439/370
8,328,570 B2 * 12/2012 Sauter ..... A61B 17/1626 439/126
9,287,646 B2 * 3/2016 Mark ..... H01R 13/005
2003/0092324 A1 * 5/2003 Walker ..... F16L 25/01 439/752
2006/0156473 A1 * 7/2006 Chambers ..... A61G 7/05769 5/713
2008/0048442 A1 * 2/2008 Kerin ..... F16L 25/01 285/305
2011/0061744 A1 * 3/2011 Zillig ..... F15B 21/042 137/15.01
2013/0143430 A1 * 6/2013 Sorolla Rosario ... H01R 13/005 439/485
2013/0267115 A1 * 10/2013 Mark ..... H01R 13/00 439/485
2014/0110382 A1 4/2014 Beliveau et al.
2014/0263680 A1 * 9/2014 Jackson, Jr. ..... F16K 17/386 236/101 R

OTHER PUBLICATIONS

Machine-generated English translation by EPO and Google, Description of WO2009027383,Continental Automotive GMBH, "Electrical connection, connection cable and using a connecting cable", retrieved Jul. 29, 2015 (13 pages).

* cited by examiner

QUICK CONNECTOR

BACKGROUND

This invention relates to a quick connector which may be used with a heater.

In the welding industry, when welding a section of thick large diameter pipe it is typical to first pre-heat the pipe section to reduce stress on the pipe. The pipe section may be rapidly heated by an induction heater wherein an electrical cable is wrapped around the pipe section and alternating current is applied to the cable. To avoid overheating the cable, it may be cooled. However, with known arrangements, it can be time consuming to mount and demount the cable and cooling system about the pipe.

SUMMARY

A quick connector has a tubular male member with an interior lumen, an outbound end configured to allow connection to a hose and to a current conductor, and a pair of opposed radially outwardly projecting protuberances. A tubular female member has an interior lumen, an outbound end configured to allow connection to a hose and to a current conductor, and an inbound end to receive an inbound end of the male tubular member. The female member has a sleeve with an undercut lip at an inbound end with opposed slots sized to receive the opposed protuberances of the tubular male member. The male member is joined to the female member by inserting the inbound end of the male member with the protuberances in registration with the slots in the sleeve until the protuberances of the male member are received through the slots and subsequently rotating the male member relative to the female member to deregister the protuberances and slots.

BRIEF DESCRIPTION OF THE DRAWINGS

In the figures which illustrate an example embodiment.

DETAILED DESCRIPTION

Figure 1:
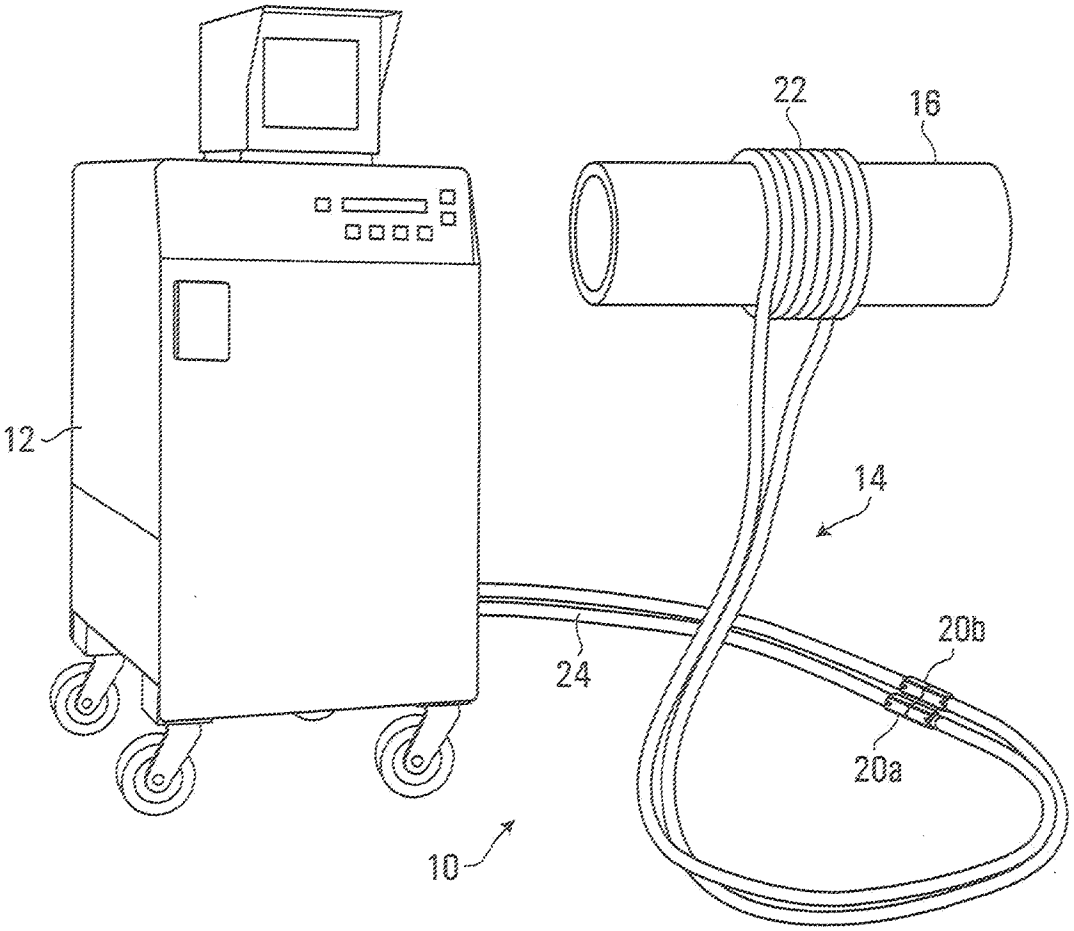
FIG. 1 is a perspective view of a weld pre-heater and a pipe section to be heated.

Turning to FIG. 1, an induction heater 10 has an electrical and cooling fluid supply 12 for supplying alternating current and cooling fluid to conduit loop 14. The conduit loop wraps around a workpiece, namely, pipe section 16. The conduit loop 14 has quick connectors 20*a*, 20*b* which allow a workpiece side 22 of the conduit loop 14 to be selectively connected to a supply side 24 of the conduit loop. With the workpiece side 22 of the conduit loop 14 separated from the supply side 24, the workpiece side of the conduit loop can be readily wrapped around the pipe 16, or removed from the pipe.

Figure 2:
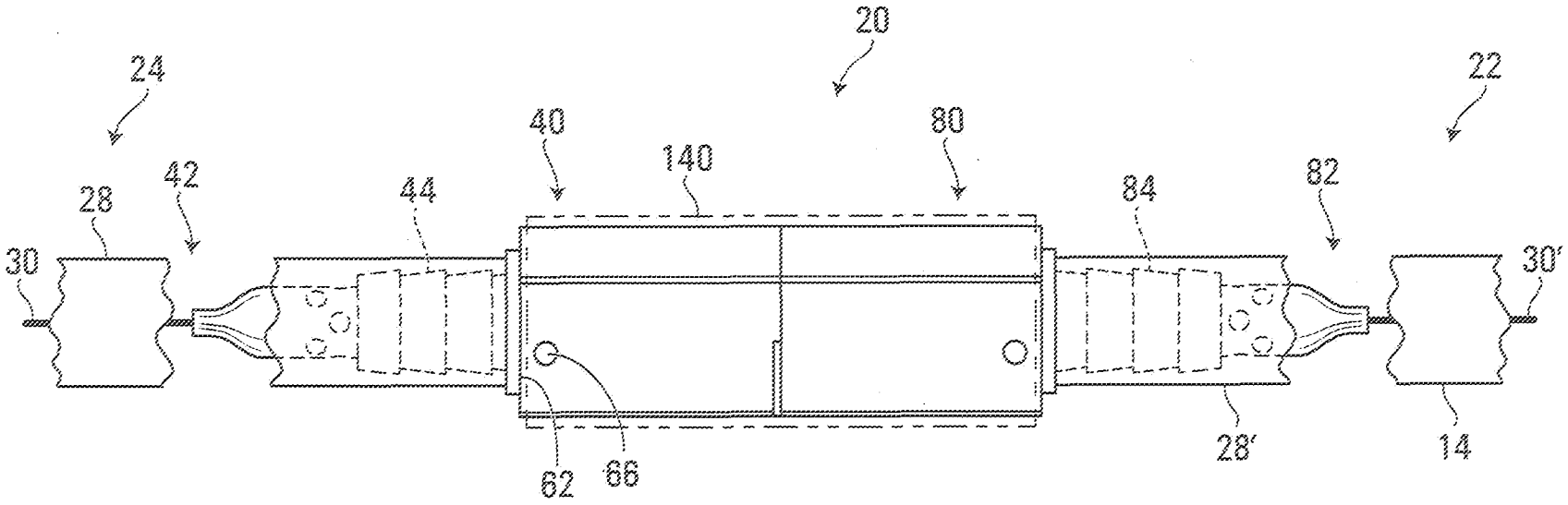
FIG. 2 is a side view of a portion of FIG. 1.

FIG. 2 illustrates a portion of conduit loop 14 at connector 20, which connector may be either connector 20*a* or 20*b*. Turning to FIG. 2, conduit 14 has an outer hose 28 surrounding an inner electrical conductor 30. The inner electrical conductor 30 at the supply side 24 of the conduit is crimped to the outbound end 42 of a male member 40 of the connector 20 and end of the outer hose is 28 is pressed over the hose barbs 44 of the male member 40. Similarly, the inner electrical conductor 30' of the workpiece side 22 of the conduit is crimped to the outbound end 82 of a female member 80 of the connector 20 and end of the outer hose 28' of the workpiece side of the conduit is pressed over the hose barbs 84 of the female member.

Referencing FIGS. 3 to 6, the male member has a current conducting tubular body 46 with an end-to-end inner lumen 48. The outbound end 42 of the male tubular body terminates in a tubular stub 50 which, as is apparent from FIG. 6, has a thinner wall than the balance of the male tubular member 46. This facilitates crimping the electrical conductor to the outbound end 42 of the male member. The male tubular body has a number of radial ports 52 extending about the circumference of the male tubular member through the tubular member from the interior lumen 48. These ports are located between hose barbs 44 and the tubular stub 50 of the male tubular member 46.

The male tubular body 46 supports a pair of opposed radially outwardly projecting cylindrical pins 54-I, 54-II toward the inbound end 56 of the male tubular member. A groove 58 in the male tubular member proximate inbound end 56 supports an O-ring 60. The male tubular member has an outbound shoulder 62 and an inbound shoulder 64. A pentagonal sleeve 70 abuts outbound shoulder 62 and is fixed to the male tubular member 46 by a pin 66 that extends through a radial opening 68 in the sleeve and into a blind opening 72 in the male tubular member. The inbound end of the sleeve 70 has an axially projecting flange 74.

The female member 80 has a current conducting tubular body 86 with an end-to-end inner lumen 88. The outbound end 82 of the female tubular body terminates in a tubular stub 90 which, as is apparent from FIG. 6, has a thinner wall than the balance of the female tubular member 86. This facilitates crimping the electrical conductor to the outbound end 82 of the female member. The female tubular body has a number of radial ports 92 extending about the circumference of the female tubular member through the tubular member from the interior lumen 88. These ports are located between hose barbs 84 and the tubular stub 90 of the female tubular member 86.

The female tubular member 86 terminates in a tulip connector 98 at its inbound end 96. The female tubular member has a medial shoulder 102. A pentagonal sleeve 110 abuts medial shoulder 102 and is fixed to the female tubular member 86 by a pin 106 that extends through a radial opening 108 in the sleeve and into a blind opening 122 in the female tubular member.

Figure 6:
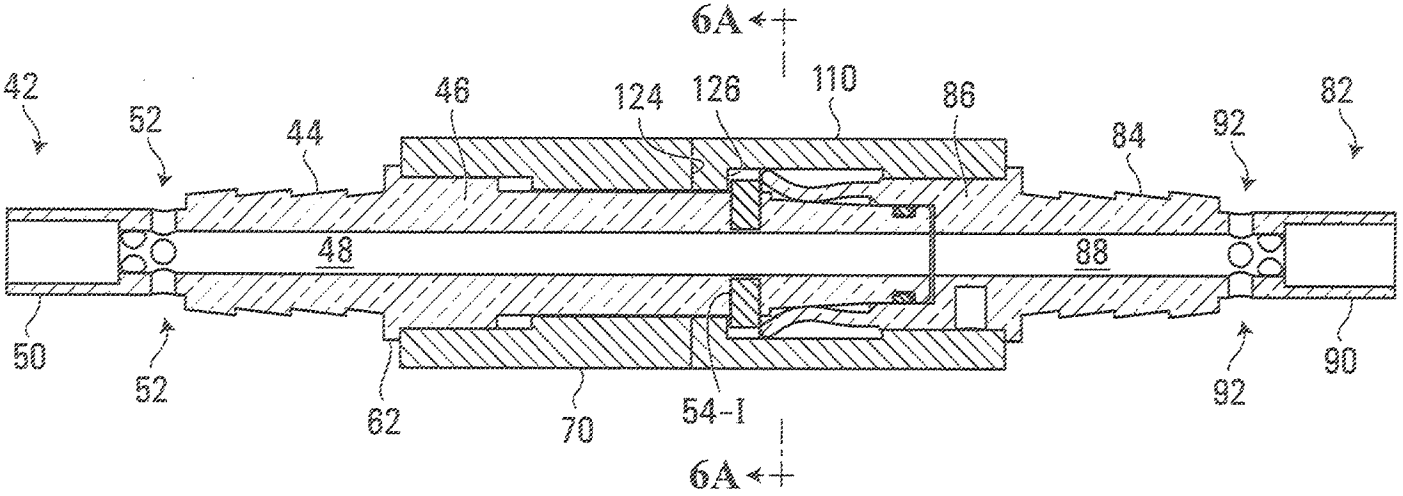
FIG. 6 is a cross-sectional view of the connector of FIG. 3.
Figure 7:
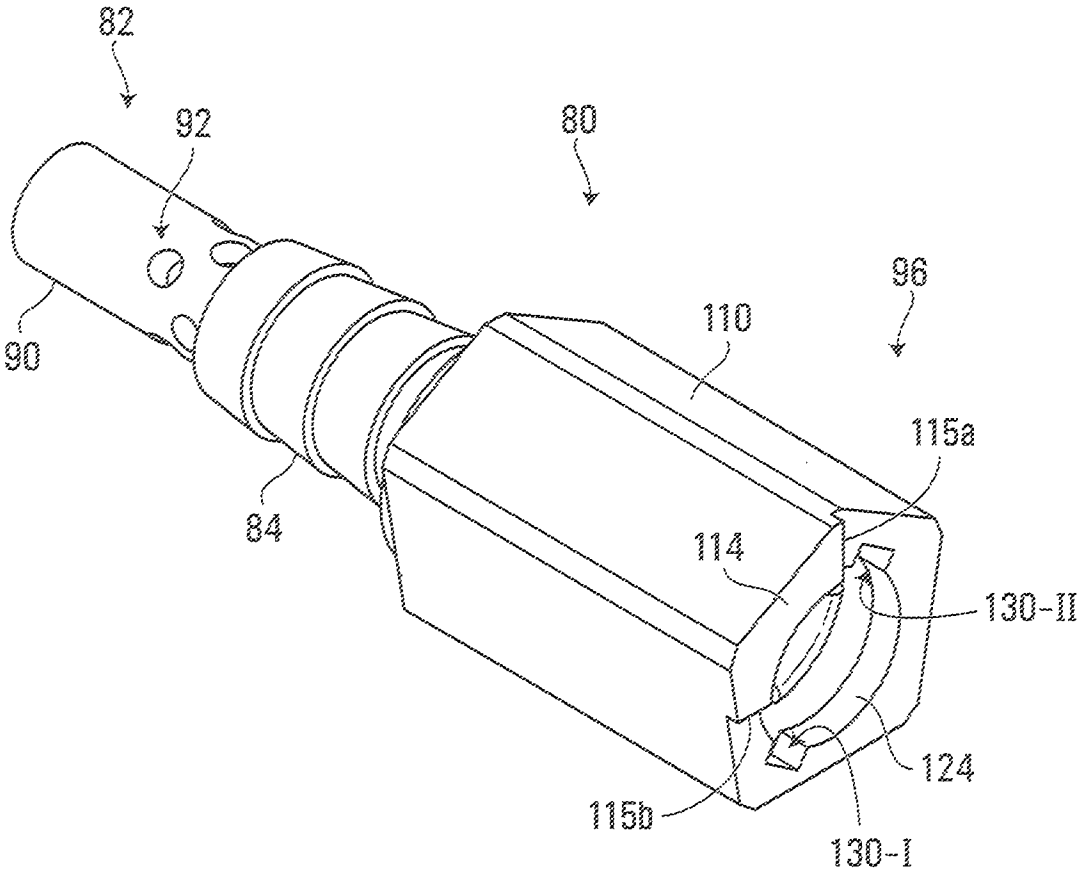
FIG. 7 is a perspective view of the female half of the connector of FIG. 3.

As seen in FIG. 6, the inbound end of pentagonal sleeve 110 has an inwardly directly lip 124 forming an undercut 126. Turning to FIG. 7, there are two radially opposite slots 130-I, 130-II in lip 124. Also, the inbound end of the sleeve 110 has an axially projecting flange 114.

Figure 6A:
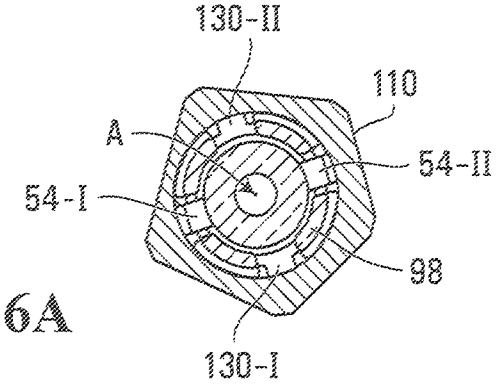
FIG. 6A is a schematic cross-sectional view of the connector along the lines 6A-6A of FIG. 6.

The male member 40 may be joined to the female member 80 by inserting the inbound end 56 of the male member into the tulip connector 98 of the female member with the pins 54-I, 54-II in registration with the slots 130-I, 130-II in the sleeve 110 of the female member. A user may readily judge approximate alignment by orienting the connector halves so the inbound face of flange 74 of sleeve 70 and the inbound face of flange 114 of sleeve 110 will not abut when the male member is inserted. Precise alignment may be indicated by a side edge 75*a* of flange 74 sliding along a side edge 115*a* of flange 114. The slots are sized to allow the pins to pass. Once the pins pass lip 124 of sleeve 110 the male member is rotated relative to the female member to deregister the pins and slots. The male member can be rotated about one-quarter turn until the other side edge 75*b* of flange 74 abuts the other side edge 115*b* of flange 114. FIG. 6A illustrates the connector with the male member rotated one-quarter turn. In this state, the pins 54-I, 54-II are angularly spaced from the slots 130-I, 130-II about central axis, A, of the connector by about 90°. The pentagonal sleeves 70, 110 allow a user to readily grip the male and female members to push them together and to twist the male member relative to the female member.

When the male member is pushed into the female member, the ends of the tulip connector of the female connector are deflected slightly outwardly which provides a frictional engagement between the male and female members and a good electrical connection between the male and female members. With the male member coupled to the female member, the O-ring 60 of the male member seals against the inside wall of the female member outbound of the tulip connector 98.

Figure 3:
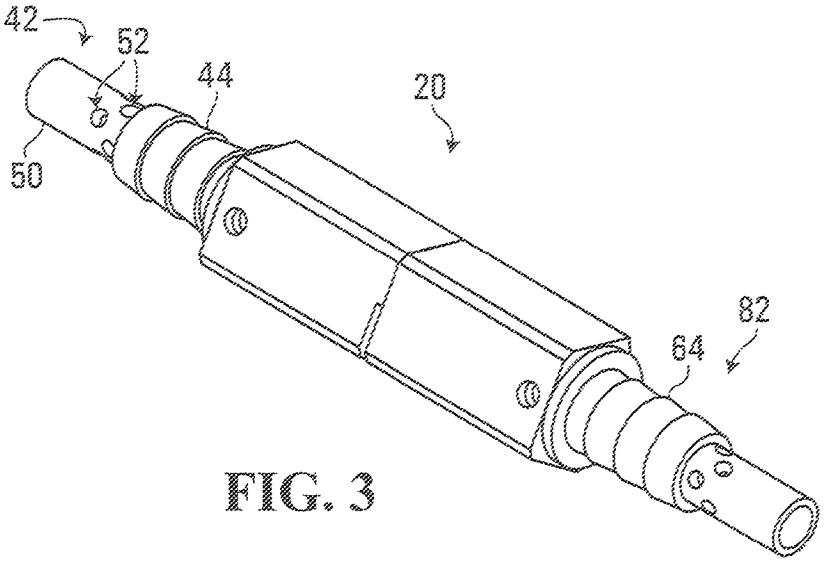
FIG. 3 is a perspective view of a coupled connector for use in the weld pre-heater of FIG. 1.
Figure 4:
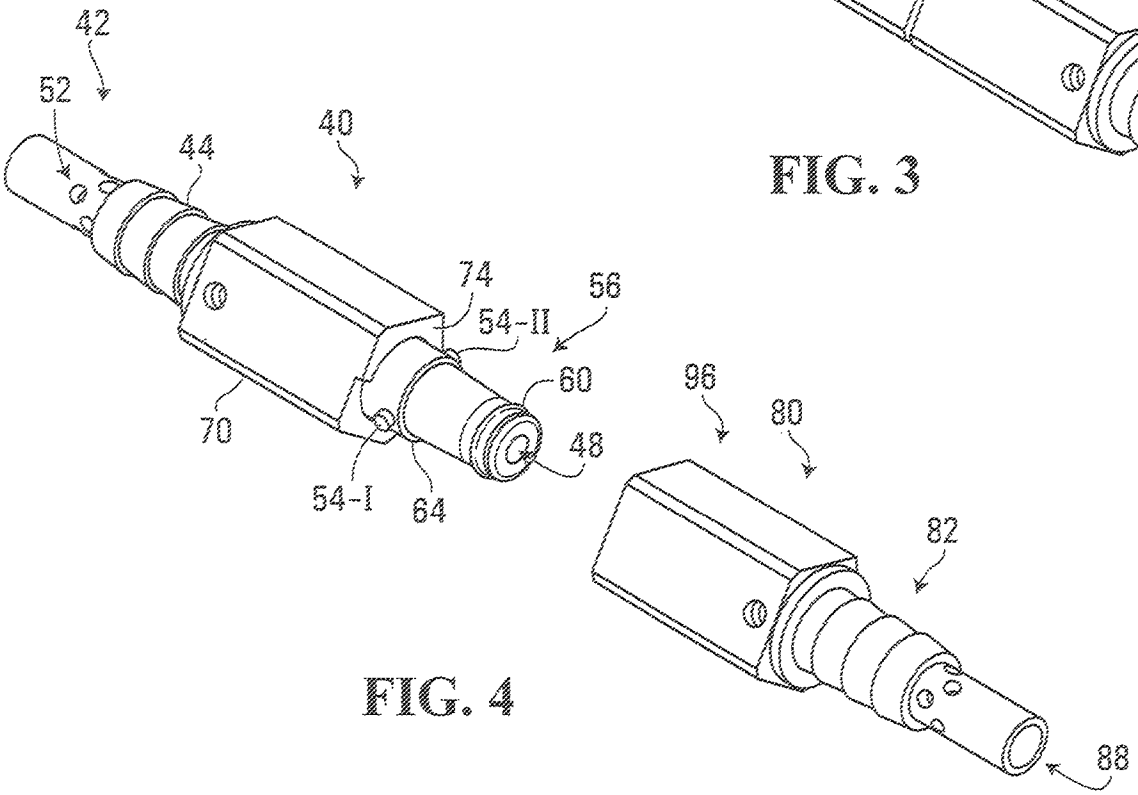
FIG. 4 is a perspective view of a decoupled connector for use in the weld pre-heater of FIG. 1.
Figure 5:
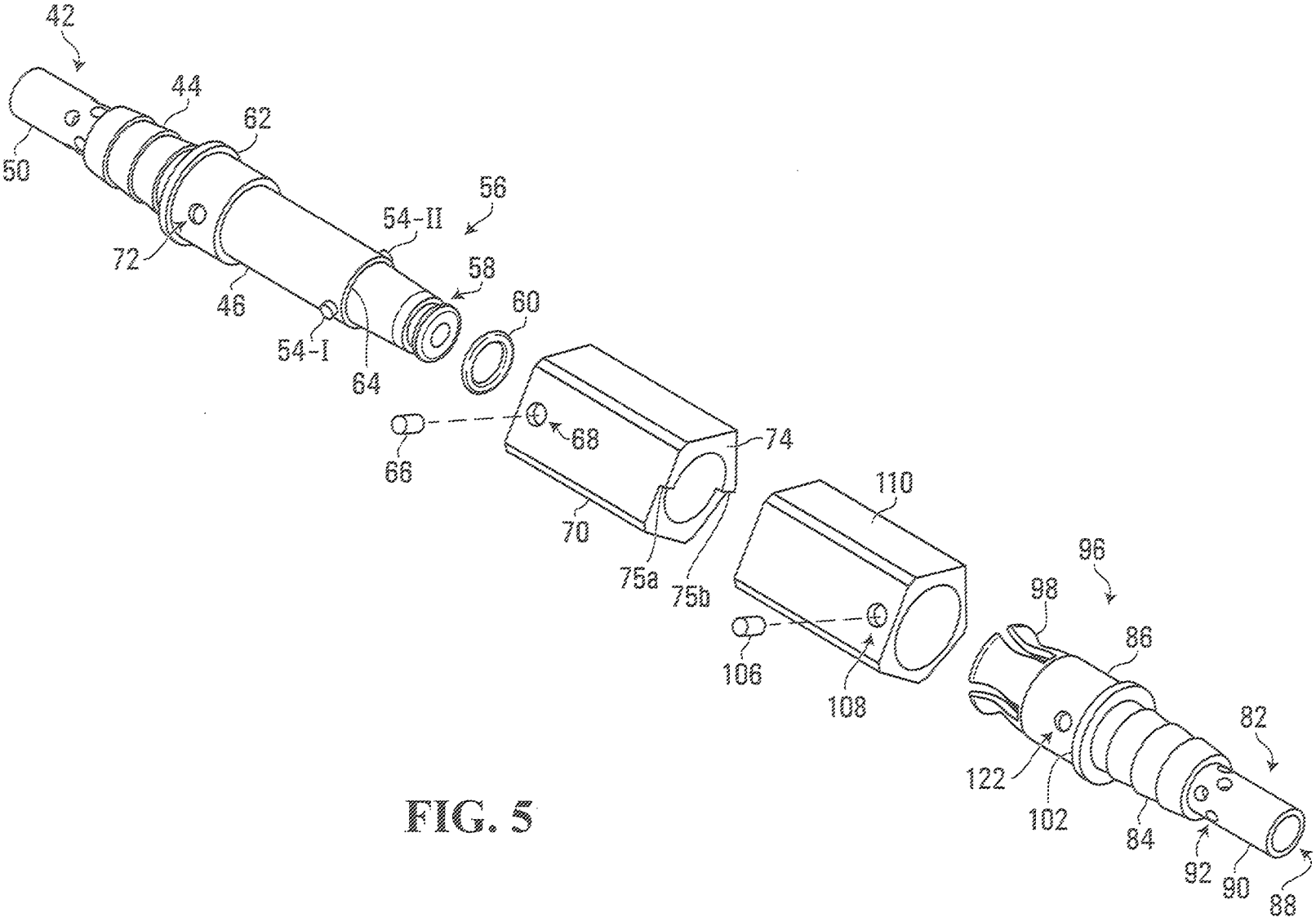
FIG. 5 is an exploded view of the connector of FIG. 3.

With the male member coupled to the female member, any attempt to withdraw the male member will result in the pins 54-I, 54-II abutting the undercut 126 at the inbound side of lip 124. FIGS. 3 and 6 illustrate the connector 20 in coupled relation.

To decouple the male and female members, the male member is rotated relative to the female member until the pins 54-I, 54-II are again in registration with slots 130-I, 130-II. The male member cannot be rotated past this point as the side edge 74*a* of flange 74 stops against the side edge 115*a* of flange 114. Once the pins are again registered with the slots, the male member can be pulled from the female member.

In operation, with the connectors 20*a*, 20*b* decoupled, the workpiece end of conduit 14 may be wrapped around pipe section 16. The male and female members of connectors 20*a*, 20*b* may then be coupled as described. Next cooling fluid may be circulated through the hose 28, 28' of conduit 14. If the connectors are oriented so that the male member is upstream of the female member, the cooling fluid, when it reaches a connector 20, will pass from hose 28 through ports 52 in the male member and then along the interior lumen 48 of the male member and into the lumen 88 of the female member. The O-ring 60 between the male and female members seals these members together against leaks as the cooling fluid passes into the lumen 88 of the female member. The cooling fluid then exits ports 92 in the female member to the hose 28' of the workpiece side 22 of the conduit 14. Additionally, alternating current may be supplied to the conductor. This current flows through the current path provided by conductor 30, the male tubular body 46, the female tubular body 86, and conductor 30'. The alternating current in the conductor 30, 30' will rapidly heat the pipe section 16 and the cooling fluid in the hose 28, 28' will keep the conductor cool.

Once the electricity is turned off and the cooling fluid is no longer circulating, the connectors may be decoupled and the workpiece side 22 of the conductor 14 removed from the pipe.

If the sleeves 70, 110 are conducting, a non-conducting envelope 140 (FIG. 2) may be placed around the sleeves so that a user can safely grip the connector when conductor 30, 30' is energised.

The described connector allows for a quick coupling and decoupling of the workpiece end of the conduit to the supply end so that the conduit can be quickly installed on, and removed from, a workpiece.

The cooling fluid may be water.

In an alternate embodiment, the undercut lip could progressively thicken with circumferential distance from one side of each of the slots 130-I, 130-II such that rotation of the male member relative to the female member in one direction draws the inbound end of said male member progressively further into the tulip connector of the female member.

While the workpiece has been described as a pipe, the workpiece could have other configurations.

The described connector could be used in other heating applications, such as for metal stress relieving, vessel heating, and weld pre or post-heating, where both electricity and fluid pass through a connector.

Other modifications will be apparent to one of skill in the art and, therefore, the invention is defined in the claims.

What is claimed is:

1. A quick connector comprising:

an electrically conductive tubular male member having:
- an interior lumen;
- an outbound end configured to allow (i) connection to a hose and (ii) an electrical connection to a current conductor;
- a pair of opposed radially outwardly projecting protuberances;

an electrically conductive tubular female member having:
- an interior lumen;
- an outbound end configured to allow (i) connection to a hose and (ii) an electrical connection to a current conductor;
- an inbound end sized to receive an inbound end of said male tubular member;

a female member sleeve mounted on said electrically conductive female member, said female member sleeve having an undercut lip at an inbound end, said undercut lip having opposed slots sized to receive said opposed protuberances of said tubular male member, said male member being joined to said female member by inserting said inbound end of said male member into said female member with said protuberances in registration with said slots in said female member sleeve until said protuberances of said male member are received through said slots and subsequently rotating said male member relative to said female member sleeve to deregister said protuberances and said slots.

2. The connector of claim 1 wherein said inbound end of said female connector comprises a tulip connector comprising petals which deflect during insertion of said inbound end of said male member and frictionally engage said inbound end of said male member.

3. The connector of claim 2 wherein said female member sleeve is multi-sided.

4. The connector of claim 2 wherein said male member outbound end has male member external hose barbs.

5. The connector of claim 4 wherein said outbound end of said male member terminates in a male member tubular stub with walls that are thin relative to walls of an inbound portion of said male member such that said male member tubular stub may be crimped to a conductor.

6. The connector of claim 5 wherein said male member external hose barbs are inbound of said male member tubular stub.

7. A quick connector comprising:

an electrically conductive tubular male member having:

an interior lumen;

an outbound end configured to allow connection to a hose and to a current conductor;

a pair of opposed radially outwardly projecting protuberances;

radial ports extending from said interior lumen of said male member at said outbound end;

an electrically conductive tubular female member having:

an interior lumen;

an outbound end configured to allow connection to a hose and to a current conductor;

an inbound end sized to receive an inbound end of said male tubular member;

a female member sleeve, said female member sleeve having an undercut lip at an inbound end, said undercut lip having opposed slots sized to receive said opposed protuberances of said tubular male member, said male member being joined to said female member by inserting said inbound end of said male member into said female member with said protuberances in registration with said slots in said female member sleeve until said protuberances of said male member are received through said slots and subsequently rotating said male member relative to said female member sleeve to deregister said protuberances and said slots.

8. The connector of claim 7 wherein said outbound end of said male member terminates in a male member tubular stub with walls that are thin relative to walls of an inbound portion of said male member such that said male member tubular stub may be crimped to a conductor.

9. The connector of claim 8 wherein said male member outbound end has male member external hose barbs inbound of said male member tubular stub.

10. The connector of claim 9 wherein said ports axially extend between said male member hose barbs member and said male member tubular stub.

11. The connector of claim 1 further comprising a male member sleeve fixed to said male member.

12. The connector of claim 11 wherein said male member sleeve is multi-sided.

13. The connector of claim 11 wherein an inbound end of said male member sleeve has an axially projecting male member flange extending about a portion of a circumference of said male member sleeve and wherein an inbound end of said female member sleeve has an axially projecting female member flange extending about a portion of a circumference of said female member sleeve.

14. The connector of claim 13 wherein said female member flange is spaced from said slots in a circumferential direction.

15. The connector of claim 14 wherein said male member flange is spaced from said protuberances in a circumferential direction so that when one side of said male member flange abuts one side of said female member flange, said protuberances are aligned with said slots.

16. The connector of claim 15 wherein said male member flange is spaced from said protuberances in a circumferential direction so that that when another side of said male member flange abuts another side of said female member flange, said protuberances are deregistered with said slots.

17. The connector of claim 15 wherein said male member flange is spaced from said protuberances in a circumferential direction so that that when another side of said male member flange abuts another side of said female member flange, said protuberances are angularly spaced from said slots about a central axis of said conductor by about ninety degrees.

18. A quick connector comprising:

an electrically conductive tubular male member defining an interior lumen, said male member having a pair of opposed radially outwardly projecting protuberances;

a first electrical conductor making an electrical connection to an outbound end of said male member;

a first hose joined to said outbound end of said male member so as to provide fluid communication between a lumen of said first hose and said interior lumen of said male member;

an electrically conductive tubular female member defining an interior lumen and having an inbound end sized to receive an inbound end of said male member;

a female member sleeve mounted on said female member, said female member sleeve having an undercut lip at said inbound end, said undercut lip having opposed slots sized to receive said opposed protuberances of said male member, a second electrical conductor making an electrical connection to an outbound end of said female member;

a second hose joined to said outbound end of said female member so as to provide fluid communication between a lumen of said second hose and said interior lumen of said female member;

said male member being joined to said female member by inserting said inbound end of said male member into said female member with said protuberances in registration with said slots in said female member sleeve until said protuberances of said male member are received through said slots and subsequently rotating said male member relative to said female member sleeve to deregister said protuberances and said slots.

19. The quick connector of claim 18 wherein said male member outbound end terminates in a male member tubular stub with walls that are thin relative to walls of an inbound portion of said male member and said male member tubular stub is crimped to said first electrical conductor to make said electrical connection to an outbound end of said male member.

20. The quick connector of claim 19 wherein said outbound end of said male member has male member external hose barbs, said first hose pressed over said external hose barbs so as to be joined to said outbound end of said male member and wherein said male member external hose barbs are inbound of said male member tubular stub.

* * * * *